US008863966B2

(12) United States Patent
Bobeck

(10) Patent No.: US 8,863,966 B2
(45) Date of Patent: Oct. 21, 2014

(54) KINGPOST CRANE APPARATUS AND METHOD

(75) Inventor: Mark Bobeck, Houston, TX (US)

(73) Assignee: Dynaking Crane, LLC, Houston, TX (US)

( * ) Notice: Subject to any disclaimer, the term of this patent is extended or adjusted under 35 U.S.C. 154(b) by 211 days.

(21) Appl. No.: 13/426,428

(22) Filed: Mar. 21, 2012

(65) Prior Publication Data

US 2012/0241404 A1 Sep. 27, 2012

Related U.S. Application Data

(60) Provisional application No. 61/454,838, filed on Mar. 21, 2011.

(51) Int. Cl.
*B66C 23/42* (2006.01)
*B66C 23/82* (2006.01)

(52) U.S. Cl.
CPC ..... *B66C 23/82* (2013.01)
USPC ..... 212/300; 212/223; 212/238

(58) Field of Classification Search
CPC ..... B66C 13/12; B66C 13/52; B66C 13/54; B66C 23/00; B66C 23/06; B66C 23/54; B66C 23/82; B66C 23/68; B66C 25/00; B66C 13/00; B66C 2700/01; B66C 2700/03
USPC ..... 212/291, 223, 232, 235, 237, 238, 253, 212/255, 260, 261, 271, 300, 71, 76
See application file for complete search history.

(56) References Cited

U.S. PATENT DOCUMENTS

| | | | | | |
|---|---|---|---|---|---|
| 1,780,806 | A | * | 11/1930 | Peyton | 414/726 |
| 2,479,838 | A | * | 8/1949 | Huston | 212/170 |
| 4,105,151 | A | | 8/1978 | Eltzroth | |
| 4,184,600 | A | | 1/1980 | Goss et al. | |
| 4,216,870 | A | | 8/1980 | Bonneson et al. | |
| 4,354,606 | A | | 10/1982 | Morrow et al. | |
| 4,513,869 | A | | 4/1985 | Goudy | |
| 4,602,462 | A | | 7/1986 | Anderson | |

(Continued)

FOREIGN PATENT DOCUMENTS

| | | | | | |
|---|---|---|---|---|---|
| EP | 232555 | A1 | * | 8/1987 | B66F 11/04 |
| RU | 2106295 | C1 | | 3/1998 | |

*Primary Examiner* — Michael Mansen
*Assistant Examiner* — Juan Campos, Jr.
(74) *Attorney, Agent, or Firm* — Garvey, Smith, Nehrbass & North, L.L.C.; Charles C. Garvey, Jr.; Vanessa M. D'Souza

(57) ABSTRACT

An improved knuckle boom crane apparatus provides a supportive base with an attached frame including a cabin with an interior. A prime mover is supported upon the frame. A main boom is pivotally attached to the frame at a first boom end portion, the main boom having a second end portion. A jib boom is provided having first and second end portions, the jib boom first end portion being pivotally attached to the main boom second end portion, the jib boom second end portion being free. A main block is attached to the main boom, depending from the main boom second end portion. An auxiliary block is attached to the jib boom, depending from the jib boom second end portion. A main block parking area is provided next to the connection of main boom and jib boom that enables the main block to be parked when using the auxiliary block.

15 Claims, 11 Drawing Sheets

(56) References Cited

U.S. PATENT DOCUMENTS

| | | | |
|---|---|---|---|
| 4,688,688 | A | 8/1987 | Volakakis et al. |
| 4,828,125 | A | 5/1989 | Svedaker |
| 5,328,040 | A | 7/1994 | Morrow |
| 5,487,478 | A | 1/1996 | Morrow |
| 5,669,517 | A | 9/1997 | Donaldson et al. |
| 6,336,565 | B1 | 1/2002 | Merkel et al. |
| 6,631,815 | B1 | 10/2003 | Laenge |
| 6,672,467 | B2 | 1/2004 | Merkel et al. |

* cited by examiner

KINGPOST CRANE APPARATUS AND METHOD

CROSS-REFERENCE TO RELATED APPLICATIONS

This is a nonprovisional patent application of U.S. Provisional Patent Application Ser. No. 61/454,838, filed 21 Mar. 2011, which is hereby incorporated herein by reference.

Priority of U.S. Provisional Patent Application Ser. No. 61/454,838, filed 21 Mar. 2011, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lifting devices, namely cranes. More particularly, the present invention relates to an improved knuckle boom king post crane apparatus that employs a rack and pinion mechanism to articulate one boom section relative to another boom section and a unique knuckle boom luffing arrangement.

2. General Background of the Invention

A knuckle boom crane is a hydraulically powered articulated arm that can be fitted to a support structure, usually a truck or trailer. The jointed sections of the boom can be folded into a small space when the crane is not in use.

Several articulated boom crane constructions have been patented. Examples of possibly relevant patents can be found below.

The following US patents for cranes listed in the table below are each incorporated herein by reference:

TABLE

| PAT. NO. | TITLE | ISSUE DATE mm/dd/yyyy |
|---|---|---|
| 4,105,151 | Crane Conversion Method | 08/08/1978 |
| 4,184,600 | Method for Removing a Bearing Assembly of a Pedestal Crane and a Removable Bearing Assembly for a Pedestal Crane | 01/22/1980 |
| 4,216,870 | Crane Mounting | 08/12/1980 |
| 4,354,606 | Bearing Assembly for a Pedestal Crane | 10/19/1982 |
| 4,513,869 | Pedestal Crane Mounting System | 04/30/1985 |
| 4,602,462 | Boom Articulating Mechanism for Aerial Devices | 07/29/1986 |
| 4,688,688 | Jib Crane Arrangement Having a Rotatable Mast | 08/25/1987 |
| 4,828,125 | Device for Maintaining a Tool Attachment in a Knuckle Boom Crane on a Constant Level Above the Ground | 05/09/1989 |
| 5,328,040 | Thrust-Centering Crane and Method | 07/12/1994 |
| 5,487,478 | Inverted Kingpost Crane | 01/30/1996 |
| 5,669,517 | Articulating Boom Incorporating a Linkage Counterweight | 09/23/1997 |
| 6,336,565 | Articulating Truss Boom | 01/08/2002 |
| 6,672,467 | Articulating Truss Boom | 01/06/2004 |

BRIEF SUMMARY OF THE INVENTION

The present invention provides an improved knuckle boom crane arrangement that is supported upon a kingpost wherein the crane's ability to handle tubulars, as well as loads of all sizes and weights, is achieved with continual safety demands associated with the handling of such products.

The present invention thus provides an improved crane design that can be mounted upon a kingpost, such as for example a 72" (1.83 m) OD columns or other size. Main and auxiliary winches can be provided which are drilling duty compliant (for example, API spec 2C $7^{th}$ edition) and equipped with an external fail safe drum brake system for additive dynamic braking redundancy.

The present invention is additionally equipped with galvanized rope, axial piston drive, hydraulic dynamic braking and boom mounted winches to eliminate hook block fouling issues when booming down.

The present invention provides a control cabin that affords exceptional operator sight to see a working area.

The present invention provides efficient main boom tubular design, structurally optimized to reduce weight and available in various length configurations, such as for example, a standard 80' (24.4 m) length.

The present invention provides a boom assembly that houses the main winch, dead end, gross overload protection or GOP, constant tension device, spherical bearing head pins, articulating cylinders and luffing sheaves.

The present invention provides a cylinder actuated rack and pinion system for jib articulation.

The present invention provides a main block parking area to allow the jib boom use without dismantling.

The present invention provides a main block 75 ton (68,039 kg) capacity at maximum 80' (24.4 m) working radius, two-part reeving, drilling duty compliant with built-in ATB (anti-tube lock). With the present invention, the jib boom can be a box type construction, light weight and available in various length configurations (such as standard 60' (18.3 m) length). The jib boom assembly houses the auxiliary winch, reversible sheave nest, articulating pinions and pipe handling attachments.

The present invention enables a wide range of drill pipe, casing and riser handling attachments.

The present invention provides an auxiliary block, such as for example 33 ton (29,937 kg) capacity, drilling duty compliant, built-in ATB.

The present invention provides an optimized bull gear and pinion design to provide smooth and secure slewing operations.

The present invention provides a fully enclosed prime mover for maximum machinery protection with removable panels to facilitate maintenance.

The present invention provides standard OSHA compliant walkways, decks and ladders to facilitate inspection and maintenance.

The present invention provides Nylatron upper and lower self aligning bearing assemblies which are easy to maintain and replace with simple hand tools.

The present invention provides a continuous luffing system reeving.

The present invention provides a rack and pinion jib boom articulation arrangement, gear phasing to reduce tooth loading and increase redundancy.

The present invention thus provides design features such as improved pipe handling, constant torsion winches, tubular main boom, redundant drives and braking, can be PLC controlled, data logging, wherein hook block reconfiguration is eliminated, and having application to jack up rigs, semi-submersible platforms, drill ships, TLPs, spars and other platforms.

The present invention provides an improved crane apparatus, namely a knuckle boom kingpost marine crane. The present invention features a knuckle boom and kingpost mounting (API Type "E" Cranes "KingPost"). In the prior art, knuckle boom marine cranes have been mounted upon a slew roller bearing mounting (API Type "C" Cranes "Roller Bearing"). This has been the case with truck mounting knuckle boom cranes, which are thus also slew bearing mounted.

In the prior art, articulation has been by means of extensible cylinders (hydraulic cylinders) which tend to be range limited. In some cases, longer booms require jib removal and re-reeving to handle larger loads.

The present design combines cylinders with a toothed gear or rack that allows for one hundred eighty (180) degrees of motion combined with the ability to store or tuck the jib into a storage position to thus eliminate the problems associated with traditional designs when handling larger loads with the main hook.

Improved main hook location and functionality are thus incorporated into the design of the present invention. The present invention has application in the retrofit of existing cranes as well.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Figure 1:
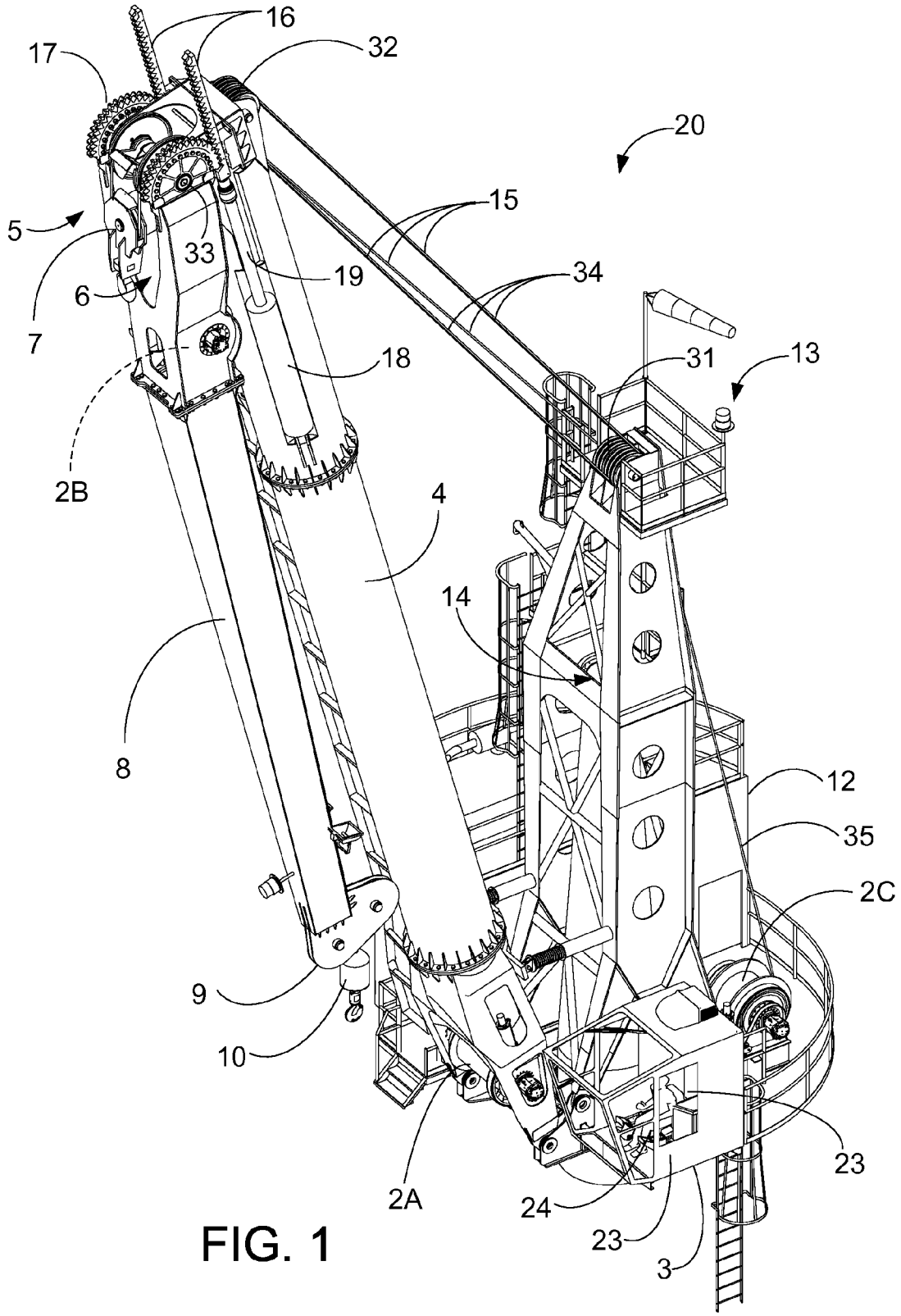
FIG. 1 is a perspective view of a preferred embodiment of the apparatus of the present invention.
Figures 2, 2A:
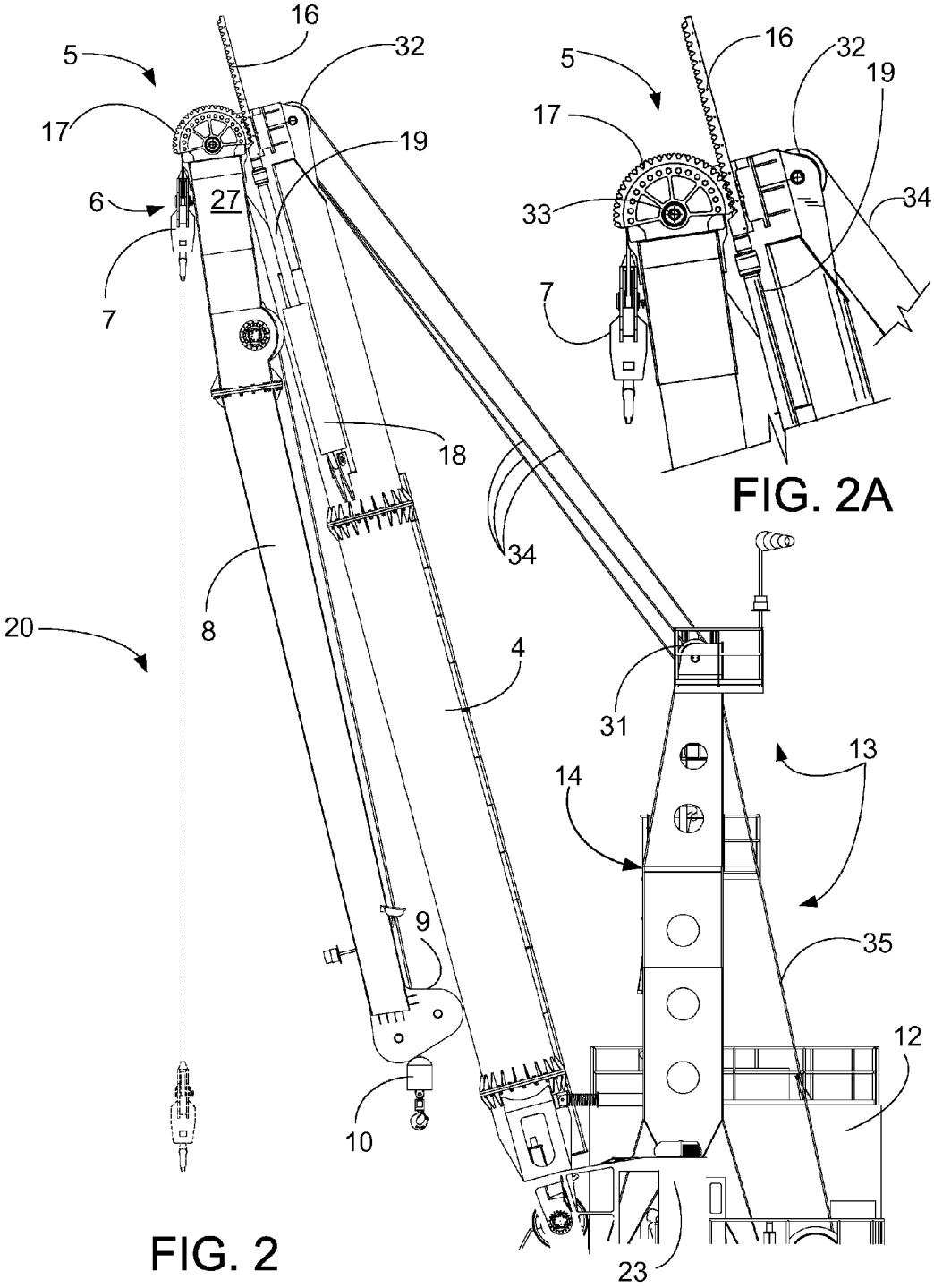
FIG. 2 is a side, elevation view of a preferred embodiment of the apparatus of the present invention.
FIG. 2A is a partial side, elevation view of a preferred embodiment of the apparatus of the present invention.
Figure 3:
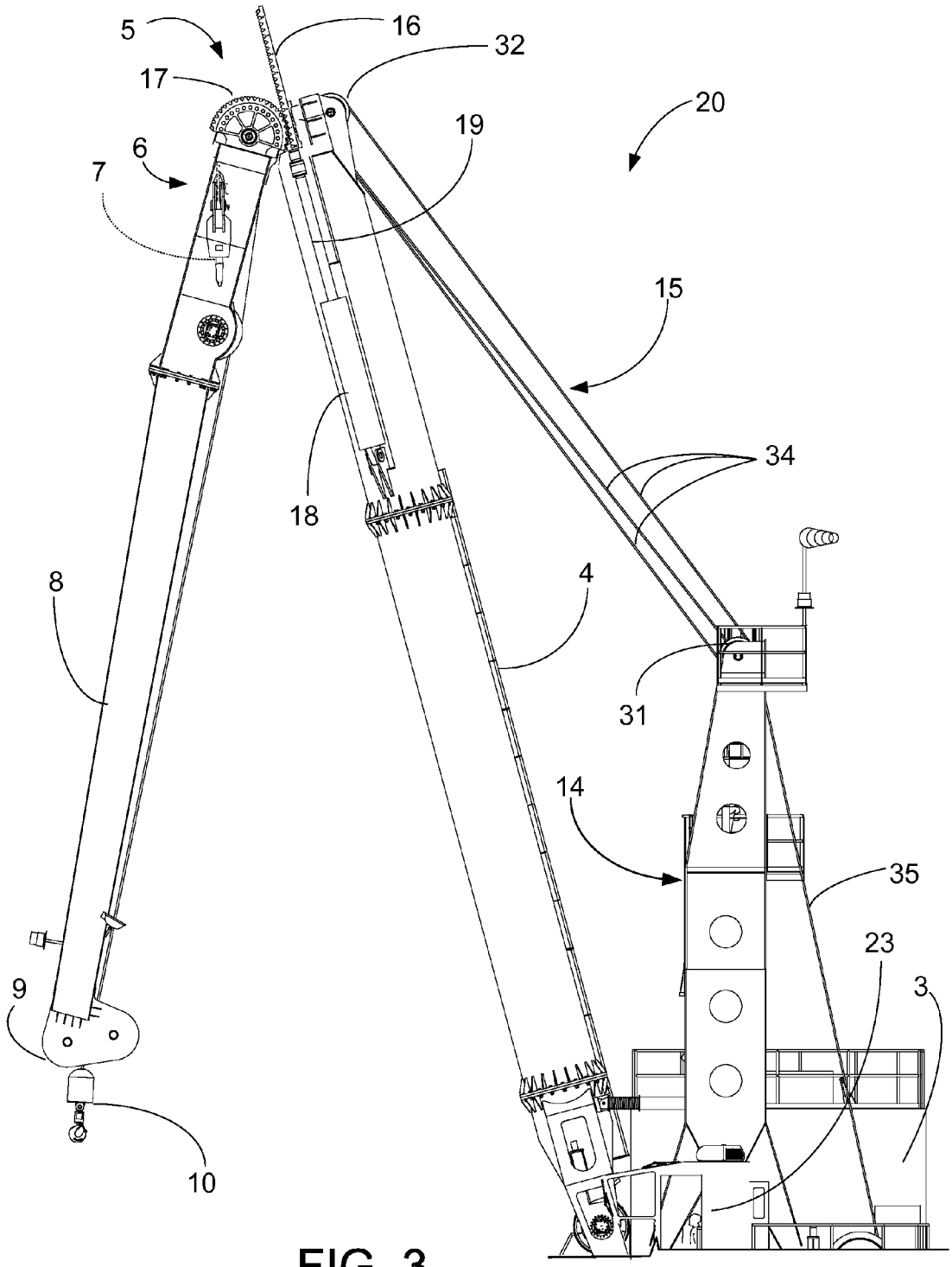
FIG. 3 is a side, elevation view of a preferred embodiment of the apparatus of the present invention.
Figure 4:
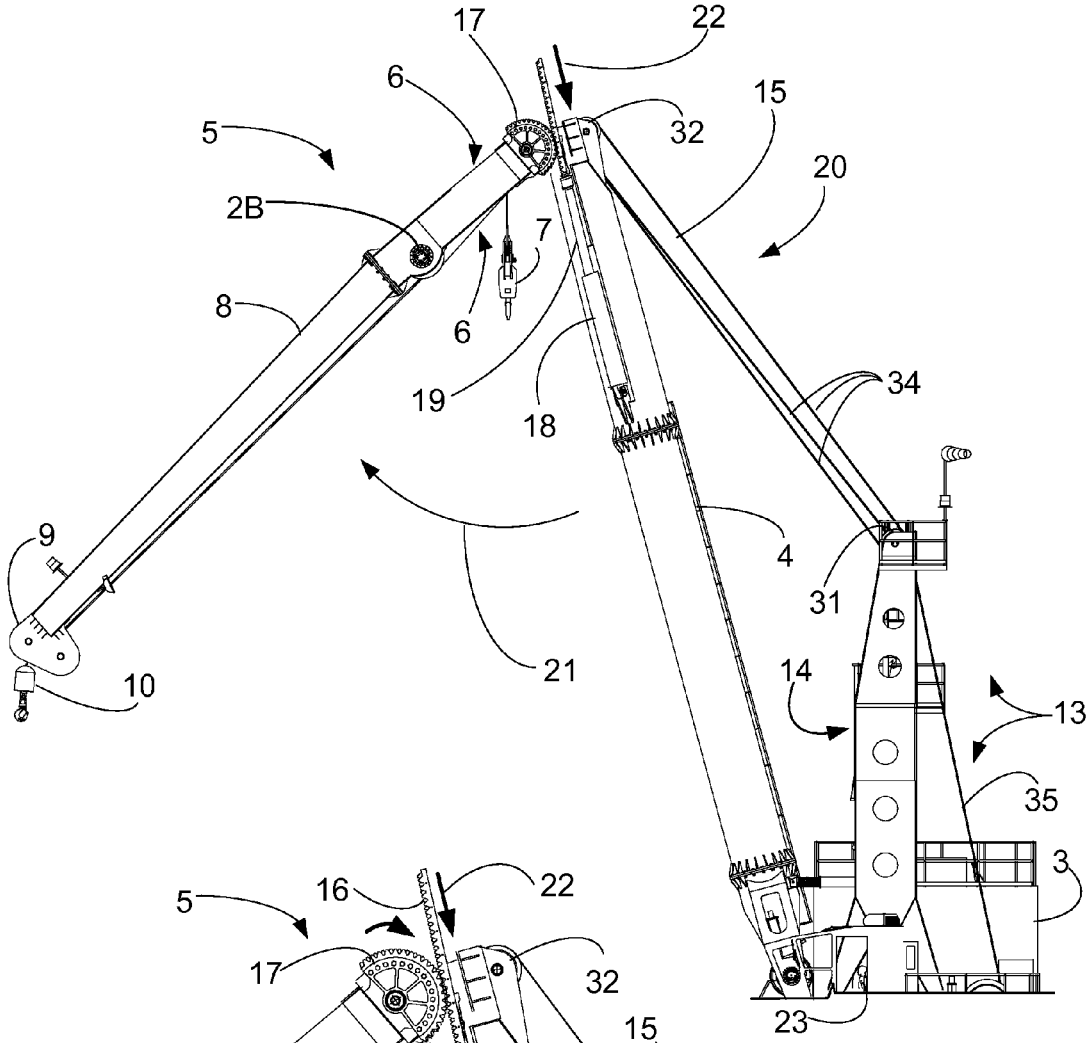
FIG. 4 is a side, elevation view of a preferred embodiment of the apparatus of the present invention.
Figure 5:
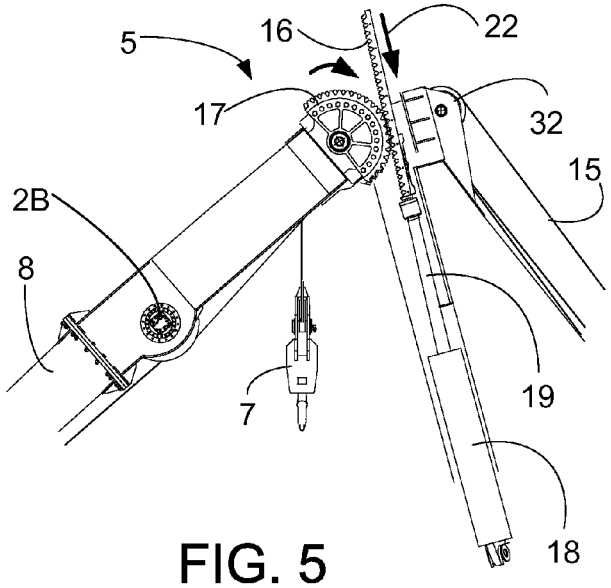
FIG. 5 is a fragmentary side elevation view of a preferred embodiment of the apparatus of the present invention.

FIGS. 1-12 show a preferred embodiment of the apparatus of the present invention designated by the numeral 20 in FIGS. 1-12. Crane apparatus 20 provides a knuckle boom kingpost crane arrangement 20 having a supporting frame, base, post or king post 1. The kingpost 1 supports frame 3 which contains prime mover 12 (e.g., diesel engine) and a cabin 23 having human operator 24. (See FIGS. 1, 8).

A main boom 4 pivotally attaches to cabin frame 3. A jib boom 8 is provided that is pivotally attached to main boom 4. At the joint or pivotal connection 33 of main boom 4 to jib boom 8, there is provided a cylinder actuated rack and pinion system for jib articulation which is designated by the numeral 5 in FIGS. 1-6. Jib boom 8 has jib tip sheave nest 9 for containing sheaves and rigging that enable auxiliary block 10 to be lifted and lowered. (See FIGS. 1-2.) The crane apparatus 20 of the present invention provides a main block parking area 6 for enabling a main block or hook 7 to be parked which allows the jib boom 8 to be used without dismantling the main block/hook 7. In FIGS. 1 and 7, the parking area 6 includes a yoke portion 25 that includes spaced apart arms 26, 27 with opening or recess 28 in between arms 26, 27.

FIG. 1 shows a main winch 2A, auxiliary winch 2B, and a boom (luffing) winch 2C. The winches 2A, 2B, 2C can be drilling duty compliant with API Spec. 2C $7^{th}$ edition. The winches 2A, 2B, 2C can be equipped with external fail safe drum braking systems for additive dynamic braking redundancy. The winches 2A, 2B, 2C would preferably be equipped with galvanized rope, axial piston drive, hydraulic dynamic braking, and stiffened boom mounts to eliminate hook block fouling issues when booming down.

The main boom 4 design can be a tubular design, structurally optimized to reduce weight and available in a number of different length configurations such as a standard 80' (24.4 m) length as an example. The boom 4 is the form of an assembly that houses the main winch 2A, dead end, GOP, constant tension drive, spherical bearing heel pin, articulating cylinders 18 and luffing sheaves.

In FIG. 7, the numeral 6 indicates generally a main block parking area to allow jib boom use without dismantling of the main block 7. Main block 7 can be for example a 75 ton (68,039 kg) capacity at maximum 80' (24.4 m) working radius, two part reeving, drilling duty compliant with built-in ATB. Main block 7, main boom 4 and main winch 2A are rigged with cable for enabling main block 7 to be lifted and lowered.

The jib boom 8 is preferably of a box type construction, being light in weight and available in various length configurations (60' (18.3 m) length as an example). The jib boom 8 assembly houses the auxiliary winch 2B, a reversible sheave nest, articulating pinions 17, and any selected pipe handling attachments. (See FIGS. 4-5, 9). An auxiliary block 10 is supported by the jib boom 8 as shown in FIGS. 1-5. Auxiliary winch 2B, jib boom 8 and auxiliary block 10 are rigged with cable to enable auxiliary block 10 to be lifted or lowered by rotating winch 2B.

A slewing drive can be provided. The slewing drive utilizes an optimized bull gear and pinion design to provide smooth and secure slewing operations. Numeral 13 in the drawings indicates generally the walkways, decks, and ladders that facilitate inspections and maintenance (see FIGS. 4, 8). Such walkways, decks, and ladders 13 can be OSHA compliant.

Nylatron upper and lower self aligning bearing assemblies (see FIG. 8, bearings 11, 14) can be provided, which are easy to maintain and replace with simple hand tools. The present invention also provides a continuous luffing system 15 using wire line or wire cable to raise and lower the main boom 4. (See FIGS. 6, 8.) As part of the luffing system, wire cable is rigged to the luffing winch 2C. First sheaves 31 connect to an upper portion of cabling 34 above the first sheaves 31, the cabling also rigged to second sheaves 32 (see FIGS. 1-4, 7-8). A lower portion of cabling 35 is rigged to sheaves 31 and winch 2C below the first sheaves 31 (see FIGS. 1-4, and 8). The upper 34 and lower portions 35 define an obtuse angle during a lifting or lowering of the main boom (see FIGS. 1-4 and 8). The second sheaves 32 are at the joint or pivotal connection 33 of main boom 4 to jib boom 8. The winch 2C pays out cable to lower main boom 4. The winch 2C retrieves cable to raise main boom 4. (See FIGS. 1, 6.)

Figure 6:
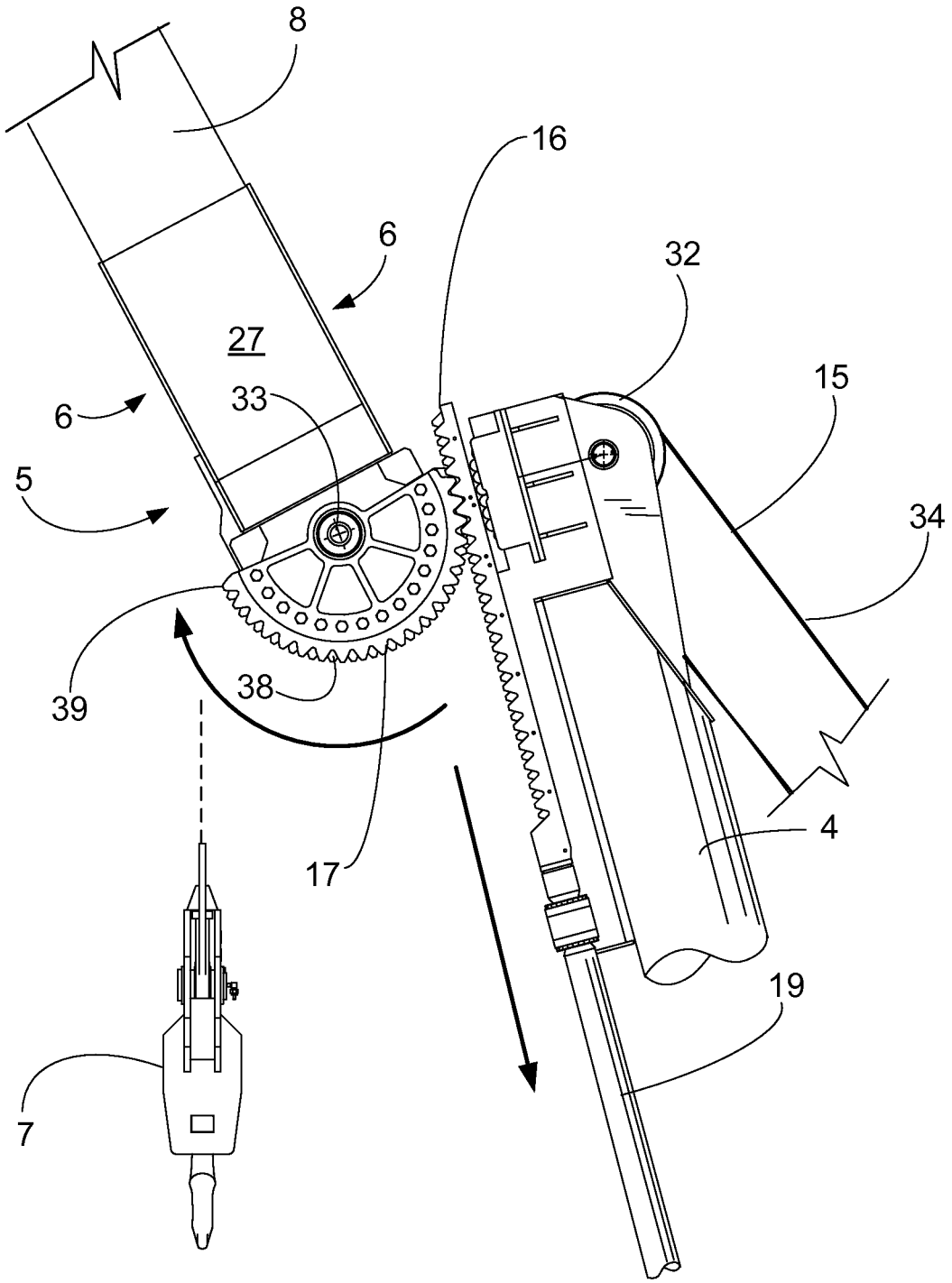
FIG. 6 is a side fragmentary view of a preferred embodiment of the apparatus of the present invention.
Figure 7:
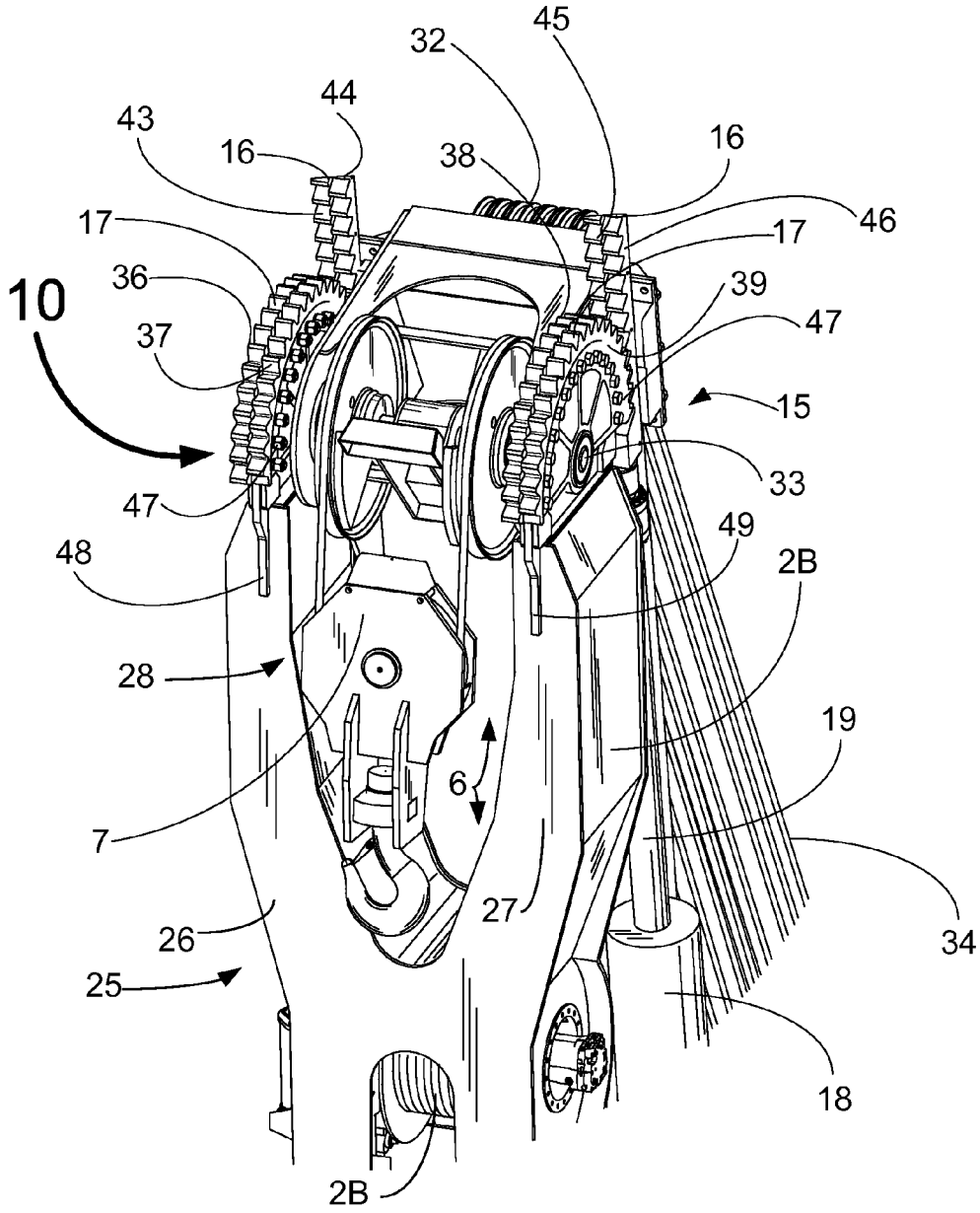
FIG. 7 is a partial perspective view of a preferred embodiment of the apparatus of the present invention.
Figure 8:
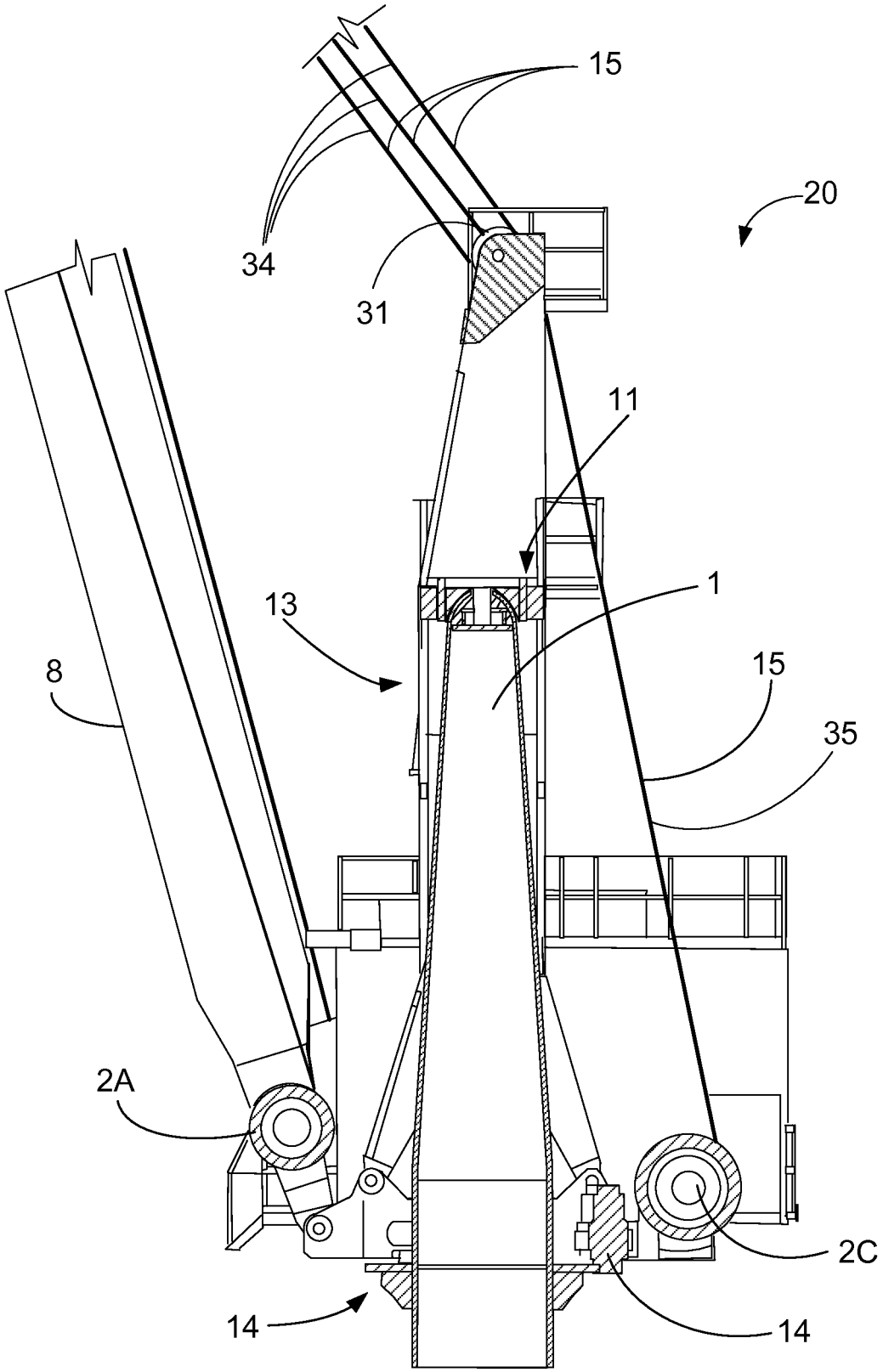
FIG. 8 is a fragmentary view of the preferred embodiment of the apparatus of the present invention.

The rack and pinion system 5 enables 180° jib boom 8 articulation (see FIGS. 1 and 6). Gear phasing is provided to reduce tooth loading and increase redundancy (see FIGS. 1 and 6). The rack and pinion arrangement 5 includes rack or rack gear 16, pinion gear 17 and hydraulic cylinder 18 having extensible rod 19. The extensible rod 19 is connected to the rack or rack gear 16 as shown in FIGS. 1-7. In this fashion, when the cylinder 18 extends the extensible rod 19, it also extends the rack or rack gear 16 which then rotates the pinion gear 17.

The various positions of the jib boom 18 can bee seen by comparing FIGS. 1 and 3-4 and 6. As the rack 16 moves downwardly (see arrow 22 in FIG. 4), the pinion 17 rotates to extend the jib boom 8 away from the main boom 4. This rotation of the jib boom 8 with respect to the main boom 4 is indicated schematically by the arrow 21 in FIG. 4. The arrow 22 indicates the downward movement of the rack 16 as cylinder 18 retracts rod 19.

Figure 9:
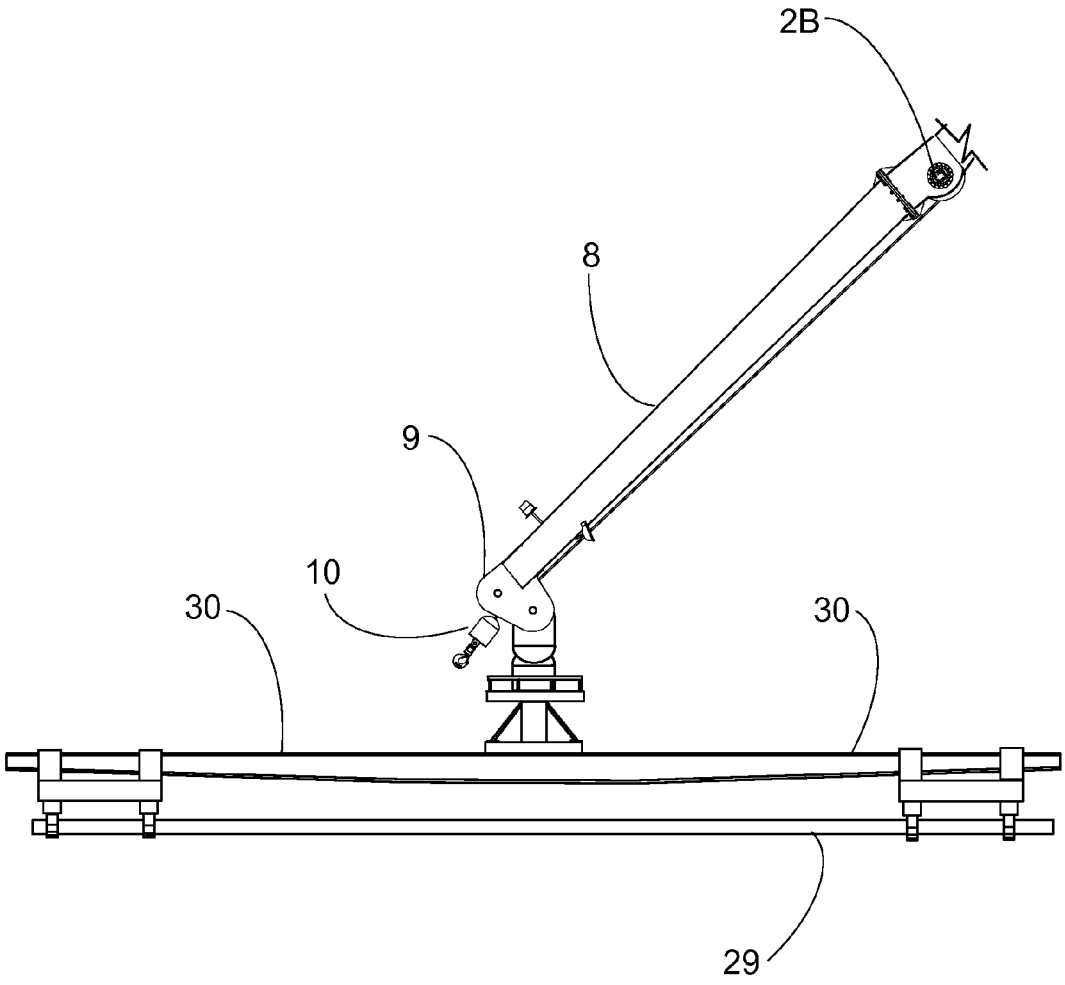
FIG. 9 is a fragmentary view of the preferred embodiment of the apparatus of the present invention.

FIG. 9 illustrates that the jib boom 8 sheave nest 9 can be used to support a pipe/riser handler 30. Such devices 30 are commercially available and can be used to lift a section of pipe 29. Such a pipe/riser handler 30 eliminates the need for a person to manually couple a section of pipe to the boom 8. There are typically three forms of pipe to handle on a drilling rig for example including drill pipe, riser pipe and casing. All three forms of pipe require a different handling attachment. Grippers or magnets for pipe and casing can be used as well as ID handlers for riser pipe, all known attachments which can be purchased and fitted to the crane apparatus 20 of the present invention.

Figure 10:
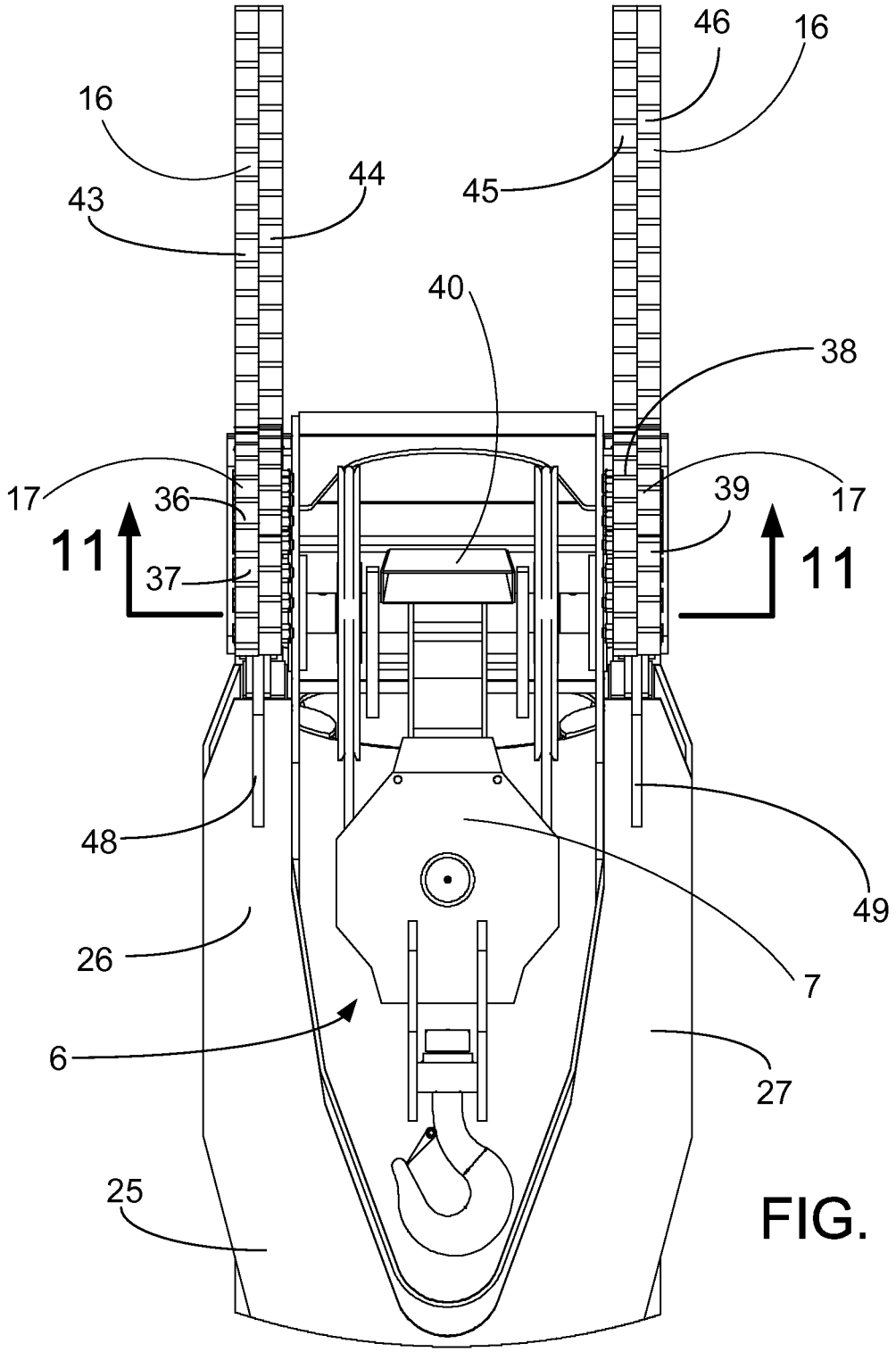
FIG. 10 is a fragmentary view of the preferred embodiment of the apparatus of the present invention.
Figure 11:
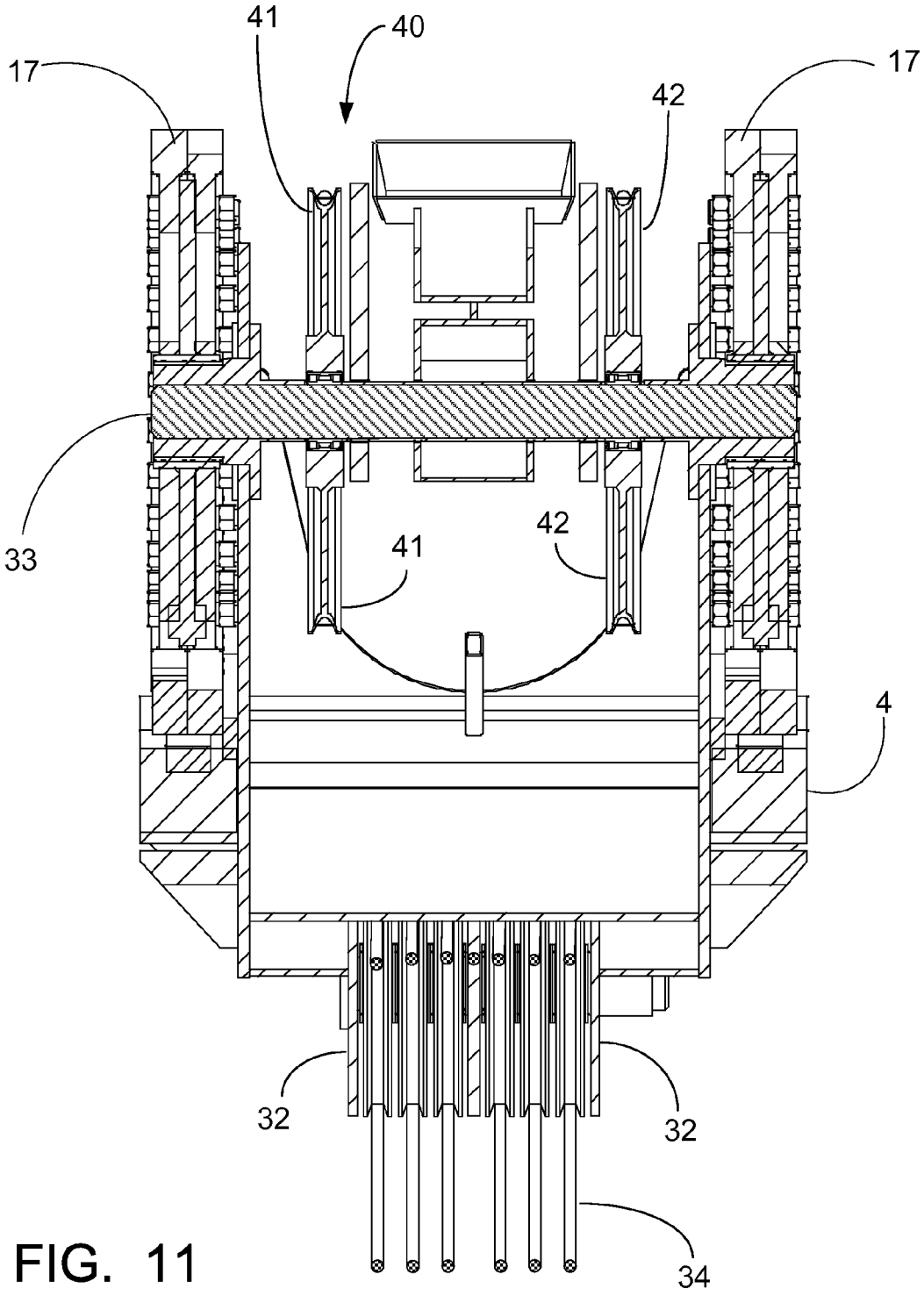
FIG. 11 is a fragmentary view of the preferred embodiment of the apparatus of the present invention.
Figure 12:
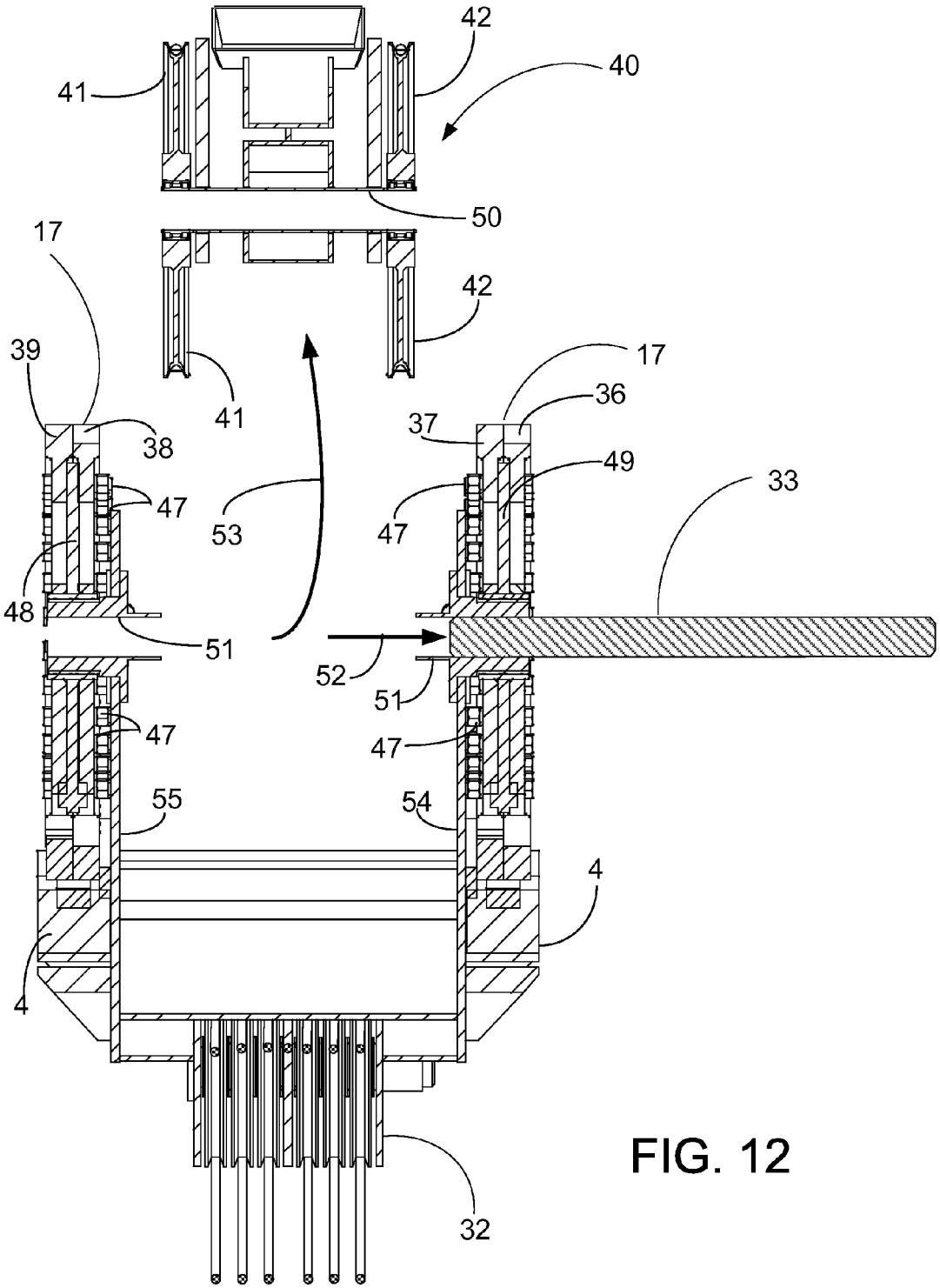
FIG. 12 is a fragmentary view of the preferred embodiment of the apparatus of the present invention.

A pinned connection can join jib boom 8 to main boom 4. FIGS. 10-12 illustrate an example of such a pinned connection of jib boom 8 to main boom 4. (See also FIG. 1.) In FIGS. 11 and 12, the upper end portion of main boom 4 is shown. Each pinion gear 17 includes preferably a pair of pinion gear sections. In FIGS. 7 and 10-11, these pairs of pinion gears include a first pair 36, 37 and a second pair 38, 39. Rack gear 16 can provide a pair of rack sections 43, 44, which engage the pair of pinion gears 36, 37. The rack section 43 engages the pinion gear section 36. The rack section 44 engages the pinion gear section 37. Similarly, the rack section 45 engages the pinion gear section 38. The rack gear section 46 engages the pinion gear section 39. Thus, the rack sections 43 and 46 are outer rack sections. The rack sections 44, 45 are inner rack sections. As shown in FIGS. 6-7, the teeth of pinion gear sections 38, 39 do not have to be aligned. Similarly, the teeth of pinion gear sections 36, 37 do not have to be aligned. Thus, the teeth of rack sections 43, 44 do not have to be aligned. Similarly, the teeth of rack sections 45, 46 do not have to be aligned.

Bolted connections 47 can be used for attaching the pinion gear sections 36, 37 together. Similarly, the pinion gear sections 38, 39 can be held together with bolted connections 47. Plates can be provided in between the pinion gear sections 36, 37 and 38, 39. Plate 48 is provided in between the pinion gears section 43, 44. Plate 49 is provided in between pinion gears sections 38, 39. Plates 48, 49 can be at attached to the arms 26, 27 of yoke portion 25 as shown in FIGS. 7 and 10. This connection of the plates 48, 49 to the yoke 25 can be a welded connection. The bolted connections 47 can secure an assembly of the pinion gear sections 36, 37 to plate 48. Similarly, the bolted connections 47 can bolt together the assembly of pinion gear sections 38, 39 and plate 49.

A sleeve or bearing at 51 is provided for receiving pin or joint or pinned connection 33 as shown in FIG. 12. Arrow 52 in FIG. 12 illustrates that pin 33 can be removed laterally for disengaging main block sheave assembly 40 from pin 33. The sheave assembly 40 can include for example sheaves 41, 42 and sleeve 50. Such a removal of the sheave assembly 40 enables it to be serviced separately from the boom sections 4 and 8. Arrow 53 in FIG. 12 illustrates removal of sheave assembly 40 from pin 33.

Plates 54, 55 in FIG. 12 are connectors that join pin 33 and boom 8 to boom 4.

Each plate 54, 55 can be welded to main boom 4. Each plate 54, 55 carries a bearing, sleeve or bearing sleeve 51 that supports pin 33. (See FIGS. 1 and 11-12).

The following table is a further numerical listing of the features of the apparatus of the present invention.

1) Kingpost design (e.g. 72" (1.83 m) OD columns).
2) Main and Auxiliary winches can be drilling duty compliant with API Spec 2C 7$^{th}$ edition and equipped with an external fail-safe drum brake system for additive dynamic braking redundancy. Additionally equipped with galvanized rope, axial piston drive, hydraulic dynamic braking, and stiffened boom mounts to eliminate hook block fouling issues when booming down.
3) Control cabin, ergonomic, spacious with exceptional operator sight. Air conditioning is standard.
4) Efficient main boom tubular design, structurally optimized to reduce weight and available in various length configurations (standard 80' (24.4 m) length as shown). Boom assembly houses the main winch, dead end, GOP (gross overload protection), constant tension device, spherical bearing heel pins, articulating cylinders and luffing sheaves.
5) Cylinder actuated rack and pinion system for jib boom articulation.
6) Main block parking area to allow jib boom use without dismantling.
7) Main block, e.g. 75 ton (68,039 kg) capacity at maximum 80' (24.4 m) working radius, 2 part reeving, drilling duty compliant with built-in ATB.
8) Jib boom can be a box type construction, light weight, and available in various length configurations (standard 60' (18.3 m) length, for example). Assembly houses the auxiliary winch, reversible sheave nest, articulating pinions, and pipe handling attachment.
9) A wide range of drill pipe, casing, and riser handling attachments can be used.
10) Auxiliary block can be 33 ton (29,937 kg) capacity, drilling duty compliant, built-in ATB.
11) Optimized bull gear and pinion design to provide smooth and secure slewing operations.
12) Fully enclosed prime mover for maximum machinery protection with removable panels to facilitate maintenance
13) Standard OSHA compliant walkways, decks, and ladders to facilitate inspections and maintenance
14) Nylatron upper and lower self aligning bearing assemblies easy to maintain and replace with simple hand tools.
15) Continuous luffing system reeving.
16) Rack and pinion, 180° jib boom articulation, gear phasing to reduce tooth loading and increase redundancy.

PARTS LIST

The following is a list of parts and materials suitable for use in the present invention, corresponding to reference numerals used in the drawings.

| Parts Number | Description |
|---|---|
| 1 | kingpost/supporting frame |
| 2A | main winch |
| 2B | auxiliary winch |
| 2C | boom (luffing) winch |
| 3 | frame |
| 4 | main boom |
| 5 | cylinder actuated rack and pinion system for jib articulation |

-continued

| Parts Number | Description |
|---|---|
| 6 | main block parking area |
| 7 | main block/hook |
| 8 | jib boom |
| 9 | jib tip sheave nest |
| 10 | auxiliary block |
| 11 | kingpost upper bearing |
| 12 | prime mover |
| 13 | walkway/deck/ladder |
| 14 | kingpost lower bearing |
| 15 | luffing system |
| 16 | rack/rack gear |
| 17 | pinion gear/gear section |
| 18 | hydraulic cylinder |
| 19 | extensible rod |
| 20 | crane apparatus |
| 21 | arrow |
| 22 | arrow |
| 23 | cabin |
| 24 | operator |
| 25 | yoke portion |
| 26 | arm |
| 27 | arm |
| 28 | recess |
| 29 | pipe section |
| 30 | pipe/riser handler |
| 31 | first sheaves |
| 32 | second sheaves |
| 33 | pin/joint/pivotal connection |
| 34 | wire rope section/cabling |
| 35 | wire rope section/cabling |
| 36 | pinion gear section |
| 37 | pinion gear section |
| 38 | pinion gear section |
| 39 | pinion gear section |
| 40 | sheave assembly/main block |
| 41 | sheave |
| 42 | sheave |
| 43 | outer rack section |
| 44 | inner rack section |
| 45 | inner rack section |
| 46 | outer rack section |
| 47 | bolted connection |
| 48 | plate |
| 49 | plate |
| 50 | sleeve |
| 51 | sleeve/bearing/bearing sleeve |
| 52 | arrow |
| 53 | arrow |
| 54 | plate |
| 55 | plate |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An improved knuckle boom crane apparatus, comprising:

a) a supportive base;

b) a frame attached to the base, said frame including a cabin with an interior;

c) a prime mover supported upon said frame;

d) a main boom pivotally attached to said frame at a first boom end portion, said main boom having a second end portion;

e) a jib boom having first and second end portions, said jib boom first end portion being pivotally attached to said main boom second end portion, said jib boom second end portion being a free end portion;

f) a main block attached to said main boom and depending from said main boom second end portion;

g) an auxiliary block attached to said jib boom and depending from said jib boom second end portion;

h) a main block parking area that enables said main block to be parked when using the auxiliary block of said jib boom, said parking area including a yoke portion that includes spaced apart arms with a recess in between said arms;

i) wherein said parking area enables said jib boom auxiliary block to lift a selected package without dismantling said main block;

j) wherein the jib boom articulates relative to the main boom with a rack and pinion gear interface that includes a rack gear and a pinion gear; and k) wherein the said rack and pinion gear interface includes an extensible hydraulic cylinder mounted on the jib boom and an extensible rod that can be extended or retracted by the cylinder and the extensible rod supporting said rack gear.

2. The knuckle boom crane apparatus of claim 1 wherein the main block is rigged with lifting line or lines and main winch, said main winch supported by said main boom.

3. The knuckle boom crane apparatus of claim 1 wherein the auxiliary block is rigged with lifting line or lines and auxiliary winch, said auxiliary winch supported by said jib boom.

4. The knuckle boom crane apparatus of claim 1 wherein the main boom is generally tubular.

5. The knuckle boom crane apparatus of claim 1 wherein the jib boom is of a rectangular box construction.

6. The knuckle boom crane apparatus of claim 1 wherein there are a pair of rack gears and a pair of pinion gears.

7. The knuckle boom crane apparatus of claim 1 wherein the base is a post.

8. An improved knuckle boom crane apparatus, comprising:

a) a supportive base;

b) a frame attached to the base, said frame including a cabin with an interior;

c) a prime mover supported upon said frame;

d) a main boom pivotally attached to said frame at a first boom end portion, said main boom having a second end portion;

e) a jib boom having first and second end portions, said jib boom first end portion being pivotally attached to said main boom second end portion, said jib boom second end portion being a free end portion;

f) a main block attached to said main boom and depending from said main boom second end portion;

g) a main block parking area that enables said main block to be parked when using the auxiliary block of said jib boom, said parking area including a yoke portion that includes spaced apart arms with a recess in between said arms;

h) an auxiliary block attached to said jib boom and depending from said jib boom second end portion;

i) rigging that interfaces the prime mover with each of said blocks, said rigging including at least a winch and cabling;

j) wherein the jib boom articulates relative to the main boom with a rack gear and pinion gear interface, and wherein the rack gear travels over less than 360 degrees of the pinion gear;

k) wherein the jib boom articulates relative to the main boom with a rack and pinion gear interface that includes a rack gear and a pinion gear; and l) wherein the said rack and pinion gear interface includes an extensible hydraulic cylinder mounted on the jib boom and an extensible rod that can be extended or retracted by the cylinder and the extensible rod supporting said rack gear.

9. The knuckle boom crane apparatus of claim 8 wherein the main block is rigged with lifting line or lines and main winch, said main winch supported by said main boom.

10. The knuckle boom crane apparatus of claim 8 wherein the auxiliary block is rigged with lifting line or lines and auxiliary winch, said auxiliary winch supported by said jib boom.

11. The knuckle boom crane apparatus of claim 8 wherein the main boom is generally tubular.

12. The knuckle boom crane apparatus of claim 8 wherein the jib boom is of a rectangular box construction.

13. The knuckle boom crane apparatus of claim 8 wherein there are a pair of rack gears and a pair of pinion gears.

14. The knuckle boom crane apparatus of claim 8 wherein the base is a post.

15. The knuckle boom crane apparatus of claim 8 wherein the rack gear moves linearly with respect to the cylinder.

* * * * *